United States Patent [19]

Blackman

[11] Patent Number: 4,785,607

[45] Date of Patent: Nov. 22, 1988

[54] APPARATUS TO FACILITATE HAND PACKING OF CONTAINERS OF DIFFERENT SIZES

[75] Inventor: Kent G. Blackman, Sycamore, Ill.

[73] Assignee: The Suter Company, Inc., Sycamore, Ill.

[21] Appl. No.: 109,235

[22] Filed: Oct. 16, 1987

[51] Int. Cl.[4] ..... B65B 67/02

[52] U.S. Cl. ..... 53/391; 53/69; 53/247; 53/252; 53/390

[58] Field of Search ..... 53/390, 391, 247, 250, 53/257, 252, 69, 64; 141/391, 378, 367, 369, 372

[56] References Cited

U.S. PATENT DOCUMENTS

| | | | |
|---|---|---|---|
| 507,870 | 10/1893 | Young | 141/378 X |
| 906,504 | 12/1908 | Brown | 141/378 X |
| 1,064,568 | 6/1913 | Toplis | 141/378 X |
| 2,155,336 | 4/1939 | Smith | 141/378 X |
| 3,494,097 | 2/1970 | Bott et al. | 53/390 X |
| 4,617,778 | 10/1986 | Blackman | 53/391 |
| 4,733,680 | 3/1988 | Mosier | 141/367 X |

*Primary Examiner*—James F. Coan
*Attorney, Agent, or Firm*—Robert J. Black

[57] ABSTRACT

Packaging apparatus for facilitating the rapid hand packing of fragile ingredients such as used in salads. Mechanisms are provided to transport empty containers to a filling station, introducing the ingredients by a hard raking procedure into the container and then further moving the containers to a weighing station and finally passing them for sealing and packaging. Facilities are included so that containers of a number of different sizes can be accommodated.

13 Claims, 3 Drawing Sheets

APPARATUS TO FACILITATE HAND PACKING OF CONTAINERS OF DIFFERENT SIZES

BACKGROUND OF THE INVENTION

1. Field of the Invention

The present invention relates to food packaging and more particularly to apparatus that facilitates the hand packing of containers of various sizes with products having fragile ingredients not usually adaptable to machine packing techniques.

2. Background Art

The automated packaging of food products is well known with special equipment being designed to facilitate the handling of the containers as taught by U.S. Pat. Nos. 1,722,048 and 4,439,101. The actual packing of the food products is taught by numerous patents, including U.S. Pat. Nos. 1,441,414, 2,664,833; 2,969,633 and 2,941,341. None of this latter group of patents, however, adapts itself to the handling of food products such as are included in specialty and refrigerated salad mixes. Most of the state-of-the-art machinery utilizes severe handling procedures that tend to break up, separate or whip together those fragile ingredients usually used in such product mixes, thus eliminating the homemade appearance and the flavor and customer acceptance most desirable in such products. Because of the fragile nature and consistency of such products, in that they do not flow by gravity, the products cannot be pumped, extruded, pressed or augered during a container filler operation. Most prior art equipment involves much rough handling of the product during the packaging operation, utilizing techniques that agitate, abuse or tear apart the ingredients so much that the desired integrity of the product is destroyed. None of the present available filling equipment marketed will satisfactorily perform the necessary tasks of properly handling such products. Hand packing of containers with ingredient mixes, such as the envisioned by the present invention, is highly satisfactory. However, the disadvantages attendant with normal hand packing procedures are obvious. Such lack of speed of handling and lack of uniformity in the handling procedure has limited hand packing in the usual sense to very small and limited operations. Other disadvantages of hand packing include the difficulty of keeping the outside of the container clean to maintain acceptable cleanliness in the sterility of the operation. Another problem is the maintenance of nearly exact weight in the container so that check weighing and any correcting operation can be held to a minimum. Conventional hand packing presents substantial problem in thse given areas.

Many of the above-noted disadvantages or problems have been overcome by apparatus disclosed in U.S. Pat. No. 4,617,778 which issued to Applicant on Oct. 21, 1986. In that application, only one size of container could be handled. Accordingly, it is the principal object of the present invention to provide all of the advantages taught by Applicant's prior invention, plus the capability of handling containers of many different sizes.

SUMMARY OF THE INVENTION

The present invention consists of apparatus to facilitate the hand packing of containers by providing an in-line system of container filling in which the containers would be stopped in position and then forced up against the underside of a plate with an opening only slightly smaller in diameter than the container to be filled. The product is then scraped by hand over the openings and into the containers located below. A relatively thin plate ensures the scraper will then fill the container almost exactly full when the product is scraped flush over the holes in the plate. Such a system keeps the outside of the container completely clean since it is clamped tightly against the underside of the opening in the filling plate.

The present invention performs a similar function to that disclosed in U.S. Pat. No. 4,617,788 which issued Oct. 21, 1986 to Applicant and is assigned to the same assignee as the present application. The present application, however, overcomes the requirement for special container size as required in the aforementioned patent. The purpose of the system disclosed herein is to allow rapid changeover from one container size to another while, at the same time, retaining the gentle handling of fragile products through the handpacked container filling operation as embodied in the above-cited patent. An additional refinement includes the utilization of a container dispensing apparatus which automatically feeds empty containers in contiguous alignment onto a single conveyor.

Rapid changeover from one container size to another is accomplished by inserting an insert plate assembly dedicated to one special container, the adjustment of a positive stop, container width guide plates and the height of the guide plate assembly. All of the above facilitate utilization of different types of containers when required. Since the number of containers that may be included for each filling cycle may vary, it is also necessary to periodically start and stop the conveyor according to the measured count of the containers as they travel along the conveyor.

In the present system, the automatic arrangement is such as to simultaneously advance filled containers and place empty one in proper location for filling. This is accomplished through the automatic and sequential energizing of air cylinders that go through a release, advance and clamp cycle. This cycle is controlled by the filling operator who depresses a foot pedal or similar apparatus after the appropriate number of containers that are in front of him have been scraped and filled. The air cylinders then operate to complete the transfer cycle in a very short time so the operator may again scrape and fill another group of empty containers.

As noted, included in the present apparatus is an automatic dispensing system to feed a constant supply of empty containers onto a moving conveyor belt. Here, periodically, the operator will randomly place empty containers onto a dispenser disk located upstream of the counting sensor. As the dispenser disk rotates, it aligns containers in contiguous position to feed directly onto the flights of the conveyor. Having the peripheral speed of the disk slightly greater than the feet per minute speed of the conveyor, a steady and contiguous supply of containers is maintained on the conveyor. The conveyor and the dispenser disk always start and stop together. Located between the dispsenser and the conveyor is a counting sensor that physically detects the presence of a container on the conveyor. It operates to count the appropriate number of containers to be utilized in connection with the filling operation, stopping the conveyor and the dispenser when the containers are of proper quantity and are in proper location.

In the present system, a quantity of product to be placed into the containers is dumped onto the top pan of the present apparatus. There the operator then checks visually to make certain that all containers are aligned and clamped securely underneath the holes in the insert plate assembly. When the containers are properly clamped, the operator then scrapes the containers level full using a special scraper similar to that disclosed in the aforereferenced patent. The scraping motion is done with a push/pull type of motion until the containers are completely filled.

When all of the containers are completely full, the operator will then depress a foot pedal or a similar mechanism to start the machine cycle. The machine cycle then releases and the lifting air cylinder lowers the filled containers onto the flights of the conveyor, and simultaneously the blocking gate at the far side of the filling station is opened and the conveyor motor and dispenser disk motor are both started causing the filled containers to be advanced, and the counting mechanism located between the dispener and the conveyor starts counting. The conveyor then moves forward carrying the filled containers downstream along with the following empty containers which, after the proper count is reached by the sensing counter, the conveyor will be stopped and braked. The adjustable positive stop gate will also be closed at this point preventing any further advancing of the containers. At this particular point in time, a new batch of empty containers is now in a stationary location underneath the holes of the insert plate which is included in the top plate of the filling apparatus.

Simultaneously as the gate is closed, the lifting air cylinder is energized, raising the lifting frame assembly which functions in turn to lift the empty containers in an upward direction toward the underside of the insert plate assembly. As they are being lifted, the empty containers are then held in their alignment by the container width guide plates which are included in the lifting frame assembly and are adjustably fastened to the container width guide plate assembly and which in turn is adjustably fastened to the lifting frame assembly. As the rising empty containers approach the underside of the insert plate assembly, the top rims of each of the containers then engage the converging slopes of centering ribs which are permanently positioned on the underside of the insert plate assembly which is specifically designed to operate with those particular containers being filled at the present time.

It should be noted that for each type of container to be utilized, a separate insert plate assembly, having specifically designed centering ribs, is utilized for each different size of container, the design of the present apparatus being such that the plate assembly can be readily changed to facilitate utilization of different size containers. In this particular way, the exact alignment of the containers underneath the holes is obtained by virtue of action against the centering ribs.

When the lifting air cylinder has completed its upward stroke, the empty containers then are tightly clamped to the underside of the insert plate assembly and are centrally located beneath each of the filling holes by the centering ribs. This completes the machine's cycle and the operator can again fill the containers with a scraping motion.

As noted previously, periodically the operator can randomly place empty containers on the dispenser disk so as to ensure a continuous supply of containers of the size adapted to be utilized with the filling plate that is presently installed in the machine.

DESCRIPTION OF THE PREFERRED EMBODIMENT

Figure 1:
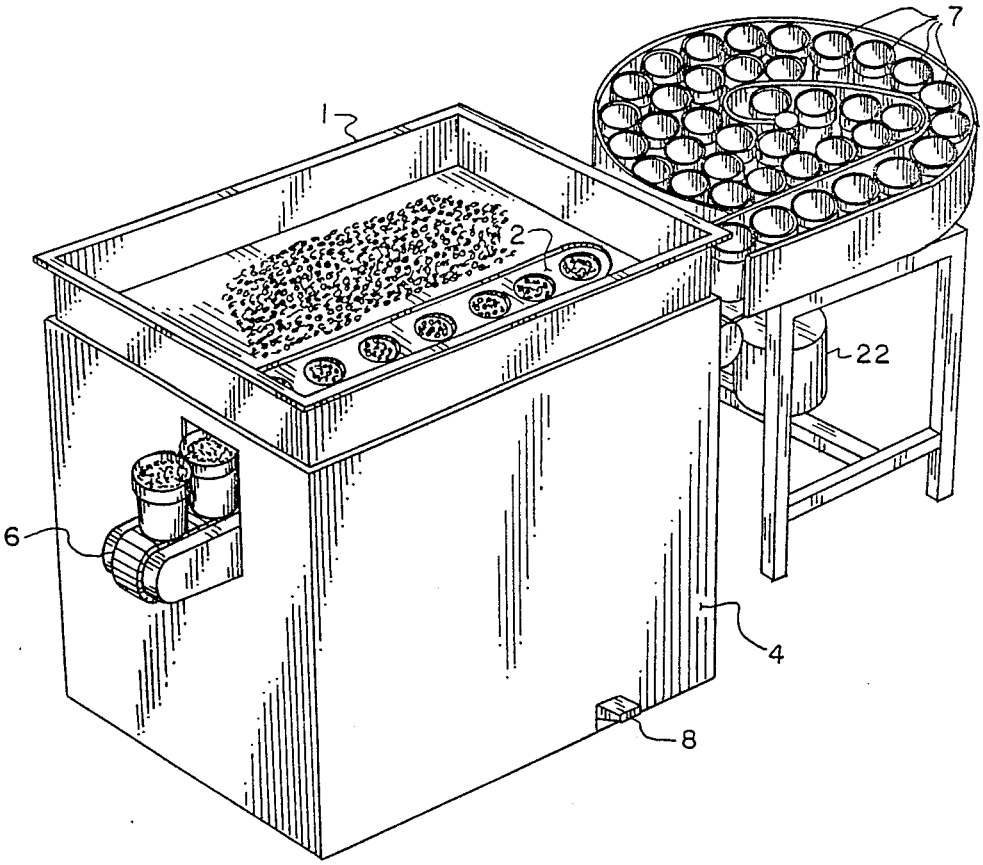
FIG. 1 is a perspective view of apparatus embodying the features of the present invention which utilizes mechanism for assisting in the hand filling of containers with fragile product mixes as described in the present invention.
Figure 2:
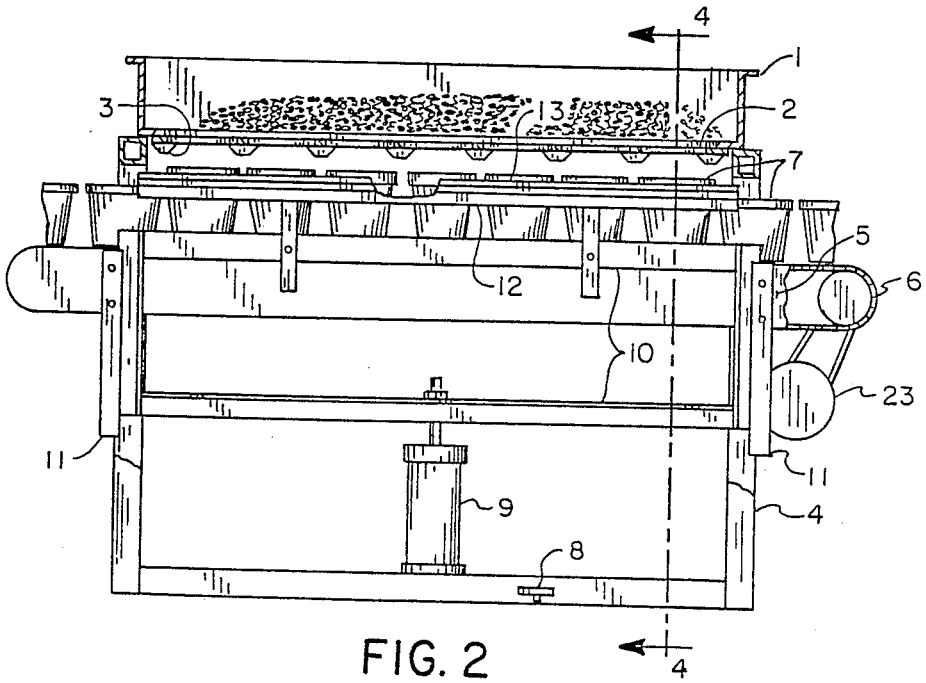
FIG. 2 is a front plan view of the present invention.
Figure 3:
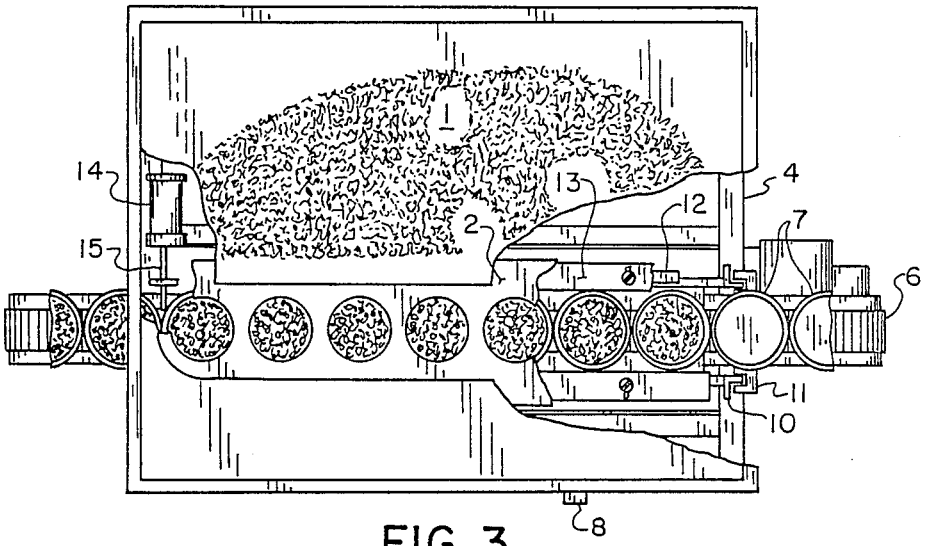
FIG. 3 is a top plan view of the present invention.
Figure 4:
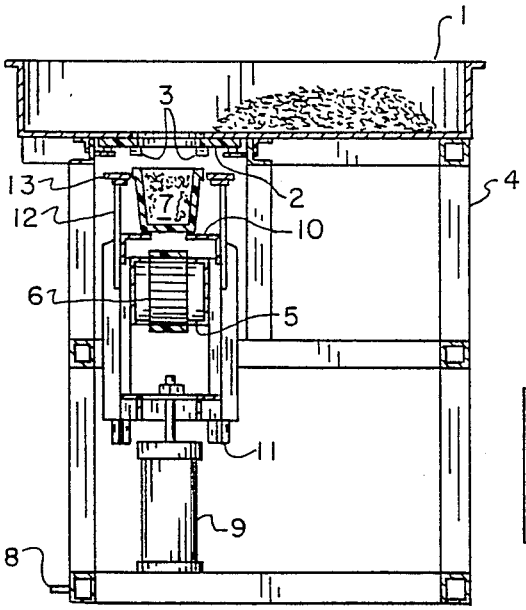
FIG. 4 is a partially sectionalized side view of the present invention.
Figure 5:
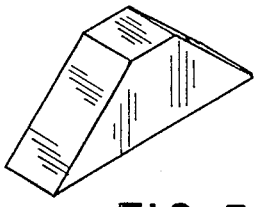
FIG. 5 is a perspective view of the centering arrangement embodied in the present invention.
Figure 6:
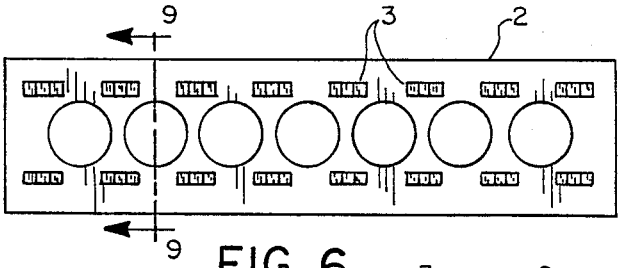
FIG. 6 is a top view of a filler insert plate as shown in the present invention being similar to that shown in the perspective drawing of FIG. 1.
Figure 7:
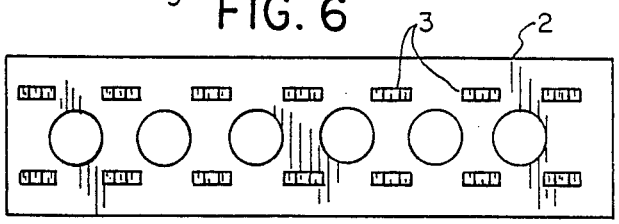
FIG. 7 is a top view of a filler insert plate for utilization in the present invention but being adapted to be used with different size containers than that shown in FIG. 6.
Figure 8:
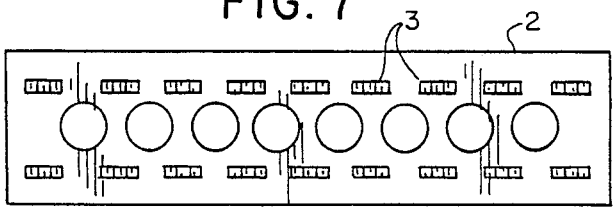
FIG. 8 is a top view of a filler insert plate for utilization in the present invention but intended for use of containers of a different configuration than those utilized with the filler plates shown in FIGS. 6 and 7.
Figure 9:
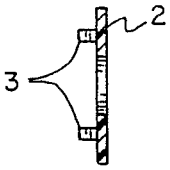
FIG. 9 is a sectional view of FIG. 6 taken along lines 9—9.
Figure 10:
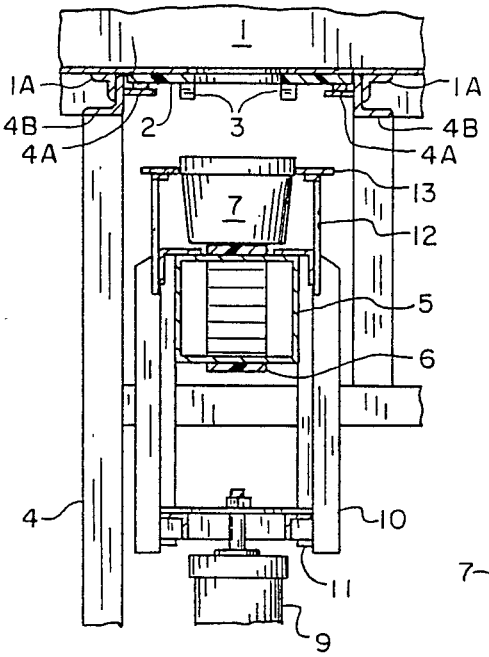
FIG. 10 is a partial side view showing the lifting frame assembly in its downward or not operated position.
Figure 12:
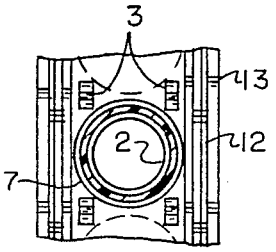
FIG. 12 is a sectional view taken along lines 12—12 showing the alignment of containers in proper position between the centering ribs of the present invention.
Figure 11:
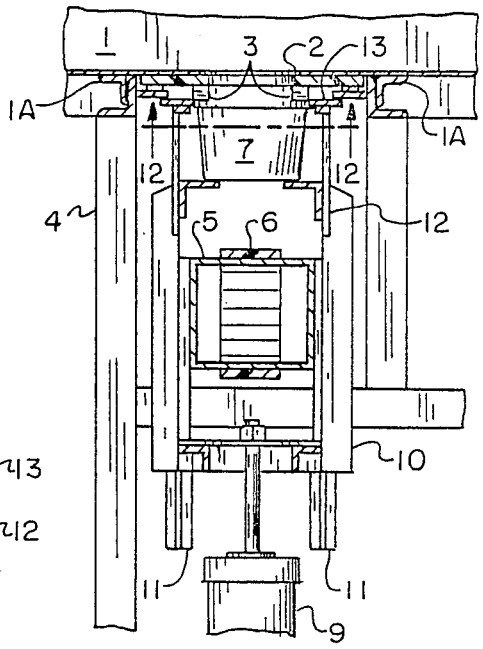
FIG. 11 is a partial side view showing the lifting frame assembly in the upper position.

Referring now to the drawing, a container filling apparatus in accordance with the present invention is shown and consists of a top pan or table portion 1 on which the product mix to be filled into the containers is deposited. Placed directly beneath a large opening therein is a universal type plate 2 in which are included a number of openings 2', each of which is of a size sufficient to be placed just over the containers to be filled. The insert plate assembly 2 includes on the bottom portion thereof centering ribs 3 which act to ensure that the containers are properly aligned with the openings in the insert plate assembly 2. The top pan 1 and the universal insert plate assembly 2 are mounted on frame assembly 4 which supports the entire structure.

Conveyor 5 is positioned below the containers moving them to their location beneath the insert plate assembly, moving unfilled containers from a container dispenser then continuing on from the present apparatus to a check/weigh station (not shown) similar to that shown in the previously cited patent for verification and determination that the containers have been properly filled to a predetermined weight. Actual movement of the containers is controlled by movement of the flights 6 which are part of the conveyor 5. As can be seen, each of the containers 7 are moved from right to left as viewed in the present drawings to the filling location and thence beyond. Operation of the apparatus is under the control of an operator who depresses a foot pedal or similar apparatus 8 to control an air cyclinder 9 which raises or lowers the lifting frame assembly 10. In operation, this operation lifts empty containers 7 upward toward the underside of the insert plate assembly 2. The lift frame assembly 10 rides from the lower to the upper position in guides 11 positioned at either end of the apparatus and on either side of the conveyor assembly.

The container 7 are maintained in proper position by the container width guide plates 13 which are adjustably fastened to the container width guide plate assembly 12 which in turn is adjustably fastened to the lifting frame assembly 10. The insert plate assembly 2 is supported on frame sections 4A and positioned between sections 4B for proper alignment. In this manner, the proper location above the conveyor 5 is ensured for proper alignment of the containers 7 for the filling operation.

Located at one end of the apparatus, as may be seen in FIG. 1, an air cylinder 14 is attached to the adjustable positive stop gate 15 attached to block or release the containers 7 as they pass through the present apparatus. Located at the other end of the conveyor mechanism and adjacent to the container dispenser is a counting sensor 18 which may take the form of a star wheel counter with a cam included which operates an on/off switch to control the forward and stop/start motion of the dispenser and the conveyor mechanism 5. Stiffner ribs 1A also extend along the opening in the top pan to ensure a rigid construction adjacent to the top plate insert so that no product may be caught between the insert plate and the top pan unit.

A more thorough understanding of the present operation may be had by reference to the following descrption in which a machine cycle sequence will be described.

After a quantity of premixed product has been dumped onto top pan 1, the operator will visually make certain that all containers 7 (a group equal in quantity to the number of holes in the top insert plate assembly 2) are aligned and clamped securely under the holes in the insert plate assembly 2. Then with the containers properly clamped, the operator will scrape the containers level and full using a special scraper (not shown but identical to that referenced in the previously cited patent). This particular scraping operation is done in a push/pull motion to ensure level filling of each container.

When each of the containers which are located beneath the openings in the insert plate assembly 2 are completely full, the operator will then depress foot pedal 8 or a similar switch to start the machine cycle. At this point, the machine cycle will cause, as may be seen by reference to FIG. 13, the release of the lifting air cylinder 9 which will then lower the lifting mechanism 10 on which filled containers 7 are located. The containers are lowered until the containers come into contact with the flights 6 of conveyor 5. At this time and simultaneously, gate 15 will be opened and conveyor motor 23 and dispenser disk motor 22 started. Now counting sensor 18 will begin counting each of the containers advancing onto the conveyor 5 which moves forward carrying the filled containers 7 downstream to a checking and weighing station and from thence to a sealing and packaging station. At the same time, the following empty containers 7, when a proper count is reached by the sensing counter 18, are advanced to a location underneath the insert plate assembly 2. When the proper count is reached (when the count is equal to the number of holes in the top insert plate), the conveyor 5 is stopped and braked and the adjustable positive stop gate 15 is closed. At this point, a new batch of empty containers 7 is now stopped underneath the holes of the insert plate assembly 2. Simultaneously, with the closure of gate 15, the lifting air cylinder 9 will be energized, raising the lifting frame assembly 10 which of course in turn lifts the empty containers 7 upward toward the underside of insert plate assembly 2. As they are being lifted, the empty containers 7 are held in their proper alignment by the container width guide plates 13 fastened to the container width guide plate assembly 12 which in turn is fastened to lifting frame assembly 10. As the rising empty containers 7 approach the underside of the insert plate assembly 2, the top rims of each of the containers 7 thus engage the converging slopes of centering ribs 3 which are positioned on the underside of insert plate assembly 2 for each dedicated container size. This way the exact alignment of containers under the openings or holes in the insert plate assembly 2 is obtained. When the lifting air cylinder 9 completes its upward stroke, the empty containers 7 are tightly clamped to the underside of the insert plate assembly 2 and are centrally located beneath the filling holes by the centering ribs 3. This completes the machine cycle and the operator can again fill the containers with a scraping motion after which the foot pedal 8 will again be reoperated to start another cycle.

Periodically, the operator will randomly place empty containers, as noted previously, on the dispenser disk which is located upsteam of the counting sensor 18. When the dispenser disk rotates, it aligns the containers in contiguous position to feed directly onto the flights 6 of conveyor 5. By having the peripheral speed of the disk slightly greater than the feet per minute speed of the conveyor, a steady and continuous supply of containers is maintained on the conveyor. As will be noted in the following description of the machine cycle sequence, the conveyor and dispenser disk always start and stop together.

Figure 13:
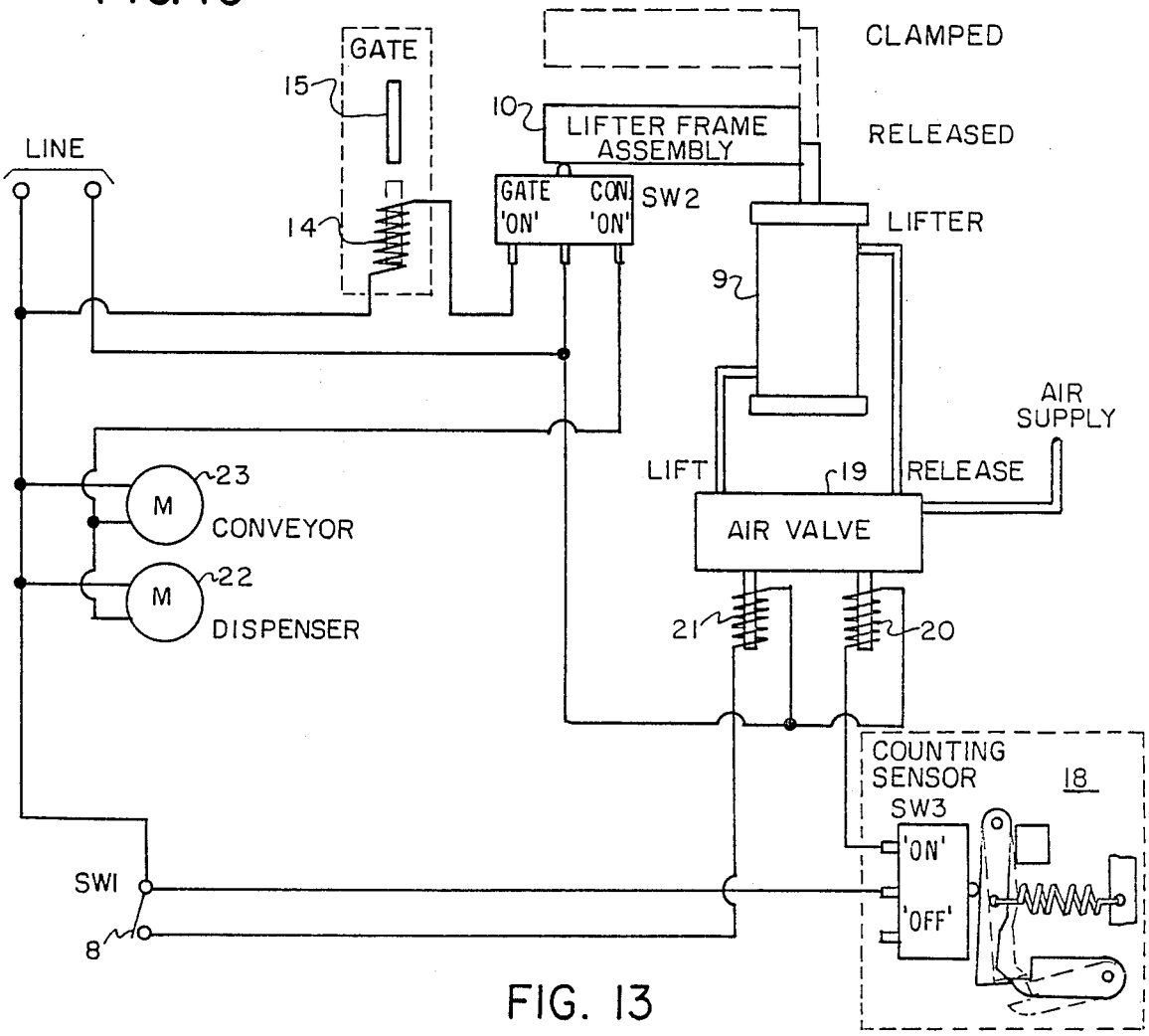
FIG. 13 is an electro-pneumatic schematic diagram of the present invention.

Referring now to FIG. 13, a further understanding of the electrical and pneumatic operation of the present invention will be further described. As shown, the operation of foot pedal 8 momentarily closes contacts to energize the foot pedal solenoid 21 on air valve 19 lifting the spool to reverse the air cylinder 9 to its release position. At the bottom of the stroke, a lifter arm, which is microswitch A, opens gate 15 and starts conveyor motor 23 and dispenser motor 22.

Empty containers moving along the conveyor 5 in continuous alignment activate sensor 18 which counts until a preset container count is reached. At the time the exact count is reached, microswitch B momentarily energizes coil 20 to shift the spool through reverse causing the spool to shift to reverse air valve 19 to start the upward or lift operation stroke of air cylinder 9. When the lifter arm starts to raise, microswitch A stops the conveyor and dispenser motors 23 and 22 respectively, returning operating gate 15 back to its normal or closed position. The machine cycle time in the present apparatus from normal to normal typically is timed to total approximately ten seconds. It should be further noted that the solenoid operated slide gate 15 may be a single action spring return solenoid operated air cylinder with about a three inch stroke. The counter wheel, cam follower and microswitch arrangement may be replaced by an accumulating pulse counter to reverse the air valve when a preset container count on the conveyor 5 is reached.

While but a single embodiment of the present invention has been shown, it will be obvious to those skilled in the art that numerous modifications may be made without departing from the spirit of the present invention which shall be limited only by the scope of the claims appended hereto.

What is claimed is:

1. Apparatus to facilitate the manual filling of a plurality of containers with a product, said apparatus comprising:

a feed-through conveyor;

a container dispenser station periodically operated to dispense containers onto said feed-through conveyor;

a lifting frame assembly positioned adjacent to said feedthrough conveyor;

said conveyor operated to position a first plurality of containers adjacent to said lifting frame assembly;

a top pan, including a replaceable filler plate, said filler plate including a plurality of openings therein said top pan and said plate supporting a quantity of said product;

said openings in said filler plate being positioned over said conveyor, each opening positioned over a different one of said first plurality of containers;

guide plates located adjacent to the underside of said filler plate, adapted to assist in the placement of said containers proper alignment beneath said openings in said filler plate assembly;

said lifting frame assembly operated to raise said first plurality of containers off of said feed-through conveyor and upward against said filler plate;

whereby said product can be manually introduced from said plate and said top pan into said plurality of containers and said containers are filled.

2. Apparatus as claimed in claim 1, wherein:

there is further included operating means;

in response to the manual initiation of said operating means, said lifting frame assembly lowered to an initial position and said filled containers returned to said conveyor; and said conveyor reoperated in response to said operation of said operating means to move a second plurality of containers to a location beneath said filler plate openings, and advancing said first plurality of containers from under said filler plate openings.

3. Apparatus as claimed in claim 1, wherein said dispenser station comprises:

a motor driven rotary plate;

a stationary wall extending about the circumference of said rotary plate;

an opening in said wall located adjacent to said feed-through conveyor and an interior guide wall extending in spiral fashion from an area adjacent to the center of said disk to form a consistently narrowing channel to said opening, whereby containers placed on said disk while said disk is operated on a rotational basis in response to operation of said motor, cause said containers positioned on said disk to be advanced in a direction through said tapering channel and then through said opening in said stationary wall to be forced forward onto said feed-through conveyor.

4. Apparatus as claimed in claim 3, wherein:

there is further included sensor means positioned adjacent to said feed-through conveyor operated in response to the passage of each container from said dispenser station to said conveyor to count the number of containers passed from said dispenser station to said conveyor, and in response to the count being equivalent to a predetermined number, operated to stop said dispenser station and operate said lifting frame assembly to raise said predetermined number of containers from said feed-through conveyor into contact against the underside of said filler plate.

5. Apparatus as claimed in claim 4, wherein:

there is further included a gate operated in response to said sensor determining said predetermined count, to block movement of said predetermined number of containers retaining said blocked containers below said filler plate openings and in response to operation of said sensor stopping said conveyor and said dispenser station.

6. Apparatus as claimed in claim 4, wherein:

said lifting frame assembly is connected to an adjacent air cylinder, said air cylinder operated to raise said lifting frame assembly in response to operation of said sensor determining said predetermined count.

7. Apparatus as claimed in claim 1, wherein:

said feed-through conveyor includes a plurality of low-friction flights and an adjustable positive stop means.

8. Apparatus as claimed in claim 1, wherein:

said lifting frame assembly is positioned over said feed-through conveyor with said assembly facilitating movement of said containers from said conveyor to be in contact with said filler plate.

9. Apparatus as claimed in claim 1, wherein:

said operating means includes at least one air cylinder connected to an associated air supply rendered operated in response to the manual operation of an associated foot pedal.

10. Apparatus as claimed in claim 1, wherein:

said filler plate openings are of the same shape as said containers but slightly smaller in size to ensure the cleanliness of the exterior of said containers when said product is introduced into said containers.

11. Apparatus as claimed in claim 10, wherein:

said operating means further includes an air cylinder connected to said lifting frame assembly operated to move said assembly from a position below said conveyor in an upward direction around said containers and into contact with said containers to force said containers in an upward direction and in contact with said filler plate.

12. Apparatus as claimed in claim 1, wherein:

said filler plate assembly is easily removable and replaceable with a second filler plate assembly with openings therein adapted to fit containers of a size different than that of said initial containers.

13. Apparatus as claimed in claim 1, wherein:

said filler plate further includes on the underside of said plate a plurality of centering ribs adapted to maintain the proper spacing between said containers as they are pressed up against the bottom of said filler plate to ensure the proper positioning of said containers beneath said filler plate assembly.

* * * * *